US008961229B2

(12) United States Patent
Pan

(10) Patent No.: US 8,961,229 B2
(45) Date of Patent: Feb. 24, 2015

(54) HIGH SPEED HIGH DENSITY CONNECTOR ASSEMBLY

(71) Applicant: Hon Hai Precision Industry Co., Ltd., New Taipei (TW)

(72) Inventor: Feng Pan, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 15 days.

(21) Appl. No.: 13/772,232

(22) Filed: Feb. 20, 2013

(65) Prior Publication Data

US 2013/0217263 A1 Aug. 22, 2013

(30) Foreign Application Priority Data

Feb. 22, 2012 (CN) ..... 2012 1 0040622

(51) Int. Cl.

| | |
|---|---|
| ***H01R 13/648*** | (2006.01) |
| ***H01R 12/71*** | (2011.01) |
| ***H01R 13/6474*** | (2011.01) |
| ***H01R 13/6587*** | (2011.01) |

(52) U.S. Cl.

CPC ..... *H01R 12/718* (2013.01); *H01R 13/6474* (2013.01); *H01R 13/6587* (2013.01); *Y10S 439/931* (2013.01)

USPC ..... 439/607.07; 439/931

(58) Field of Classification Search

USPC ..... 439/607.06, 607.07, 931

See application file for complete search history.

(56) References Cited

U.S. PATENT DOCUMENTS

| | | | | |
|---|---|---|---|---|
| 5,066,236 | A * | 11/1991 | Broeksteeg | 439/79 |
| 5,718,606 | A | 2/1998 | Rigby et al. | |
| 5,980,321 | A | 11/1999 | Cohen | |
| 6,293,827 | B1 * | 9/2001 | Stokoe | 439/607.07 |
| 6,347,962 | B1 | 2/2002 | Kline | |
| 6,409,543 | B1 | 6/2002 | Astbury, Jr. | |
| 6,443,740 | B1 | 9/2002 | Evans | |
| 6,471,549 | B1 | 10/2002 | Lappohn | |
| 6,491,545 | B1 * | 12/2002 | Spiegel et al. | 439/579 |
| 6,506,076 | B2 | 1/2003 | Cohen | |
| 6,551,140 | B2 * | 4/2003 | Billman et al. | 439/607.07 |
| 6,592,381 | B2 | 7/2003 | Cohen | |
| 6,709,294 | B1 | 3/2004 | Cohen | |
| 6,814,619 | B1 | 11/2004 | Stokoe | |
| 6,843,687 | B2 * | 1/2005 | McGowan et al. | 439/607.06 |
| 6,872,085 | B1 | 3/2005 | Cohen | |
| 6,899,548 | B2 | 5/2005 | Houtz | |
| 6,994,569 | B2 | 2/2006 | Minich | |
| 7,320,621 | B2 | 1/2008 | Lourx | |

(Continued)

FOREIGN PATENT DOCUMENTS

| | | | |
|---|---|---|---|
| CN | 1094860 | A | 11/1994 |
| CN | 2519434 | Y | 10/2002 |

(Continued)

*Primary Examiner* — Gary Paumen

(74) *Attorney, Agent, or Firm* — Ming Chieh Chang; Wei Te Chung

(57) ABSTRACT

An electrical connector assembly includes plural wafers that are stacked. Each wafer includes a conductive board defining plural slots therein, and plural contact modules each received in one of the slots. The conductive board is made from plastic coated with metal plating to improve shielding performance. Each of the contact modules includes a pair of contacts and an insulating holder fixing the contact pair to the conductive board. The insulating holder is differently void along the contact pairs to improve impedance.

18 Claims, 18 Drawing Sheets

(56) References Cited

U.S. PATENT DOCUMENTS

| | | | | |
|---|---|---|---|---|
| 7,335,063 | B2 | 2/2008 | Cohen | |
| 7,371,117 | B2 | 5/2008 | Gailus | |
| 7,581,990 | B2 | 9/2009 | Kirk | |
| 7,594,826 | B2 * | 9/2009 | Kobayashi et al. | 439/607.07 |
| 7,722,401 | B2 * | 5/2010 | Kirk et al. | 439/607.07 |
| 7,753,731 | B2 * | 7/2010 | Cohen et al. | 439/607.09 |
| 7,758,357 | B2 * | 7/2010 | Pan et al. | 439/108 |
| 7,887,371 | B2 * | 2/2011 | Kenny et al. | 439/620.22 |
| 7,931,474 | B2 * | 4/2011 | Laurx et al. | 439/65 |
| 8,123,563 | B2 * | 2/2012 | Kenny et al. | 439/620.22 |
| 8,157,595 | B2 * | 4/2012 | Saraswat et al. | 439/620.09 |
| 8,398,431 | B1 * | 3/2013 | Whiteman et al. | 439/607.06 |
| 8,475,209 | B1 * | 7/2013 | Whiteman et al. | 439/607.07 |
| 8,500,487 | B2 * | 8/2013 | Morgan et al. | 439/607.06 |
| 2001/0005654 | A1 | 6/2001 | Cohen et al. | |
| 2002/0098738 | A1 * | 7/2002 | Astbury et al. | 439/608 |
| 2002/0111069 | A1 * | 8/2002 | Astbury et al. | 439/608 |
| 2004/0171305 | A1 * | 9/2004 | McGowan et al. | 439/608 |
| 2007/0004282 | A1 | 1/2007 | Cohen et al. | |
| 2009/0017682 | A1 | 1/2009 | Amleshi | |
| 2010/0144201 | A1 * | 6/2010 | Defibaugh et al. | 439/607.05 |

FOREIGN PATENT DOCUMENTS

| | | | |
|---|---|---|---|
| CN | 2599781 | Y | 1/2004 |
| CN | 1643742 | A | 7/2005 |
| CN | 201196992 | Y | 2/2009 |
| CN | 101728667 | A | 6/2010 |
| CN | 101752700 | A | 6/2010 |
| CN | 101783449 | A | 7/2010 |
| CN | 201741935 | U | 2/2011 |
| CN | 201820905 | U | 5/2011 |
| CN | 102185196 | A | 9/2011 |
| EP | 0422785 | A2 | 4/1991 |

* cited by examiner

HIGH SPEED HIGH DENSITY CONNECTOR ASSEMBLY

CROSS-REFERENCE TO RELATED APPLICATIONS

This patent application is related to a U.S. patent document No. 2012/0252271 A1, published on Oct. 4, 2012, and entitled "HIGH SPEED HIGH DENSITY CONNECTOR ASSEMBLY," which is assigned to the same assignee as this application.

BACKGROUND OF THE INVENTION

1. Field of the Invention

The present invention relates to a high speed high density connector assembly, and more particularly, to a high speed high density connector assembly having stacked contact wafers that are completely shielded.

2. Description of the Prior Art

Many prior art references disclose high speed high density connector assemblies with shielding structures. U.S. Pat. No. 6,709,294 B1, issued to Cohen et al. on Mar. 23, 2004, discloses an electrical connector having electrical conductors in a plurality of rows. Each of the plurality of rows includes a housing and a plurality of electrical conductors. Each electrical conductor has a first contact end connectable to a printed circuit board, a second contact end, and an intermediate portion therebetween that is disposed within the housing. The housing includes a first region surrounding each of the plurality of electrical conductors, the first region made of insulative material and extending substantially along the length of the intermediate portion of the electrical conductors. The housing also includes a second region adjacent the first region and extending substantially along the length of the intermediate portion of the electrical conductors. The second region is made of a material with a binder containing conductive fillers providing shielding between signal conductors. Furthermore, in discussing background art in U.S. Pat. No. 6,709,294, it is mentioned that a solution is introduced to provide shields through plastics coated with metals, but there are no combination of readily available and inexpensive metals and plastics that can be used, such as the plastic lacks desired thermal or mechanical properties, available plating techniques are not selective, etc.

U.S. Pat. No. 6,471,549 B1, issued to Lappohn on Oct. 29, 2002, discloses a shielded plug-in connector. The plug-in connector has a jack-in-blade strip having at least one first contact element and an edge connector having at least one second contact element corresponding to the first contact element. The edge connector, on or in its outer body areas, has at least partially shielding sheets. Shielding of the plug-in connector is achieved by, in addition to the shielding sheets provided on the edge connector, a shielding group with at least one first element arranged in the jack-in-blade strip. The first element of the shielding group is a base part in the form of a U-shaped rail. The shielding sheets on the edge connector have a planar body and angled stays. Two of the angled stays and a portion of the planar body between the two angled stays form a counterpart to the base part, wherein the counterpart and the base part together substantially encapsulate the first and second contact elements.

U.S. Pat. No. 7,581,990 B2, issued to Kirk et al. on Sep. 1, 2009, discloses a waferized electrical connector incorporating electrically lossy material selectively positioned to reduce crosstalk without undesirably attenuating signals. Wafer may be formed in whole or in part by injection molding of material to form its housing around a wafer strip assembly. A two shot molding operation may be adopted, allowing the housing to be formed of two types of material having different material properties, namely an insulative portion being formed in a first shot and lossy portion being formed in a second shot. The housing may include slots that position air, or create regions of air, adjacent signal conductors in order to provide a mechanism to de-skew a differential pair of signal conductors.

OBJECTS OF THE INVENTION

A main object of the present invention is to provide a high speed high density electrical connector assembly with improved shielding performance and ease of assembling.

The present invention first provides an electrical connector adapted to be mounted onto a printed circuit board (PCB), comprising a plurality of wafer stacked in a transverse direction. Each of the wafers further comprises a conductive board and a plurality of contact modules. The conductive board having a first face and an opposite second face perpendicular to the transverse direction, the first face defining a plurality of slots therein. Each of the contact modules is received in one of the slots, each contact module comprising an insulating holder and a pair of contacts extending in a signal path, each of said contacts having a contacting portion, a foot portion, and an intermediate portion connecting the contacting portion and the foot portion, the intermediate portions of the contacts in the pair being parallelly fixed in the insulating holder and kept isolated from each other. Each pair of contacts are punched from a metal plate and kept in a planar surface with near edges facing to each other and far edges backing away from each other, the far edges of the intermediate portions embedded in the insulating holder and the near edges of the intermediate portions exposed to air in part length of the signal path.

The present invention secondly provides a contact wafer adapted for an electrical connector. The contact wafer comprises a conductive board, plural insulating holders, and plural pairs of contacts. The conductive board defining plural slots in a side face, the plural slots extending along parallel paths from a first board edge to a second board edge in the side face. The plural insulating holders are received in the slots. The plural pairs of contacts are adapted to transfer differential signal, each pair of the contacts extending along the path of a corresponding slot and kept isolated from the conductive board by a corresponding insulating holder. The conductive board is formed by molded plastic coated with metal plating.

BRIEF DESCRIPTION OF THE DRAWINGS

The features of this invention which are believed to be novel are set fourth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
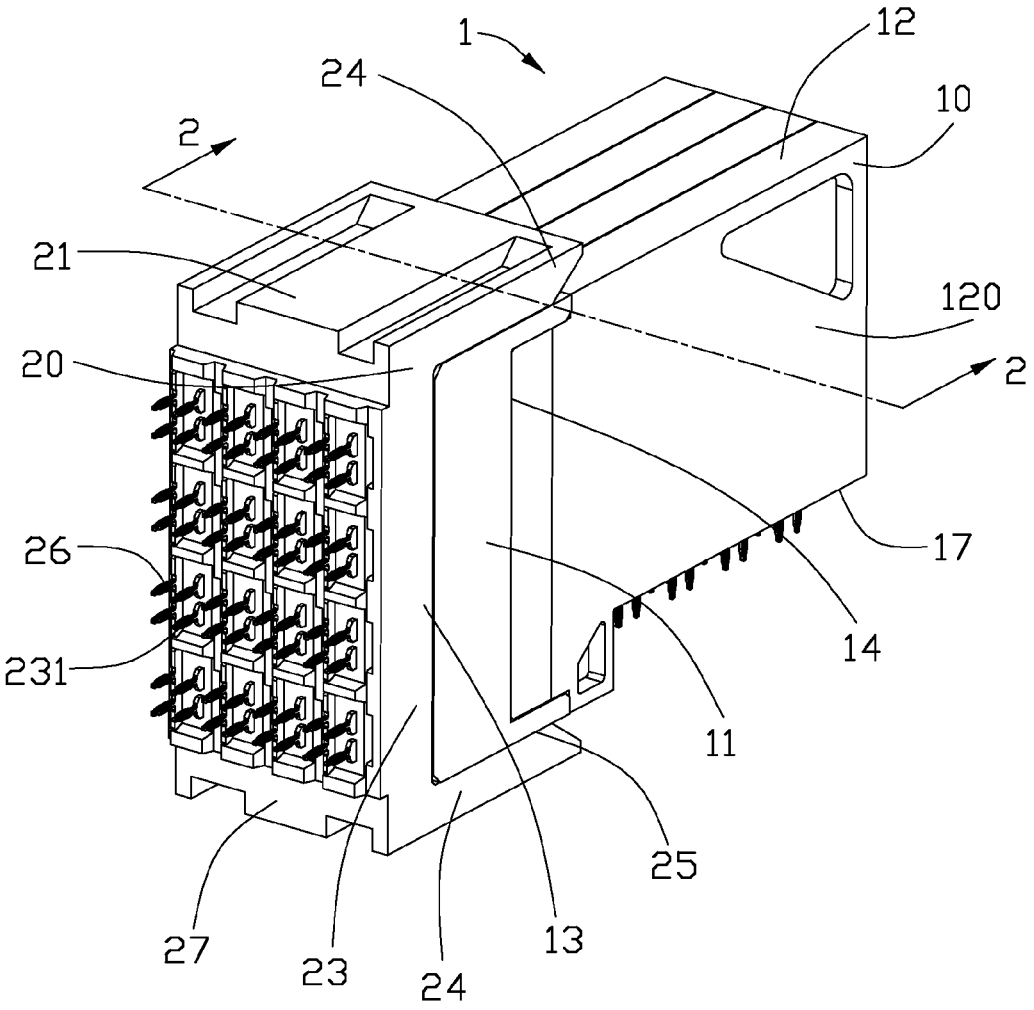
FIG. 1 is a perspective view of a connector assembly of according to a first embodiment of the present invention.
Figure 2:
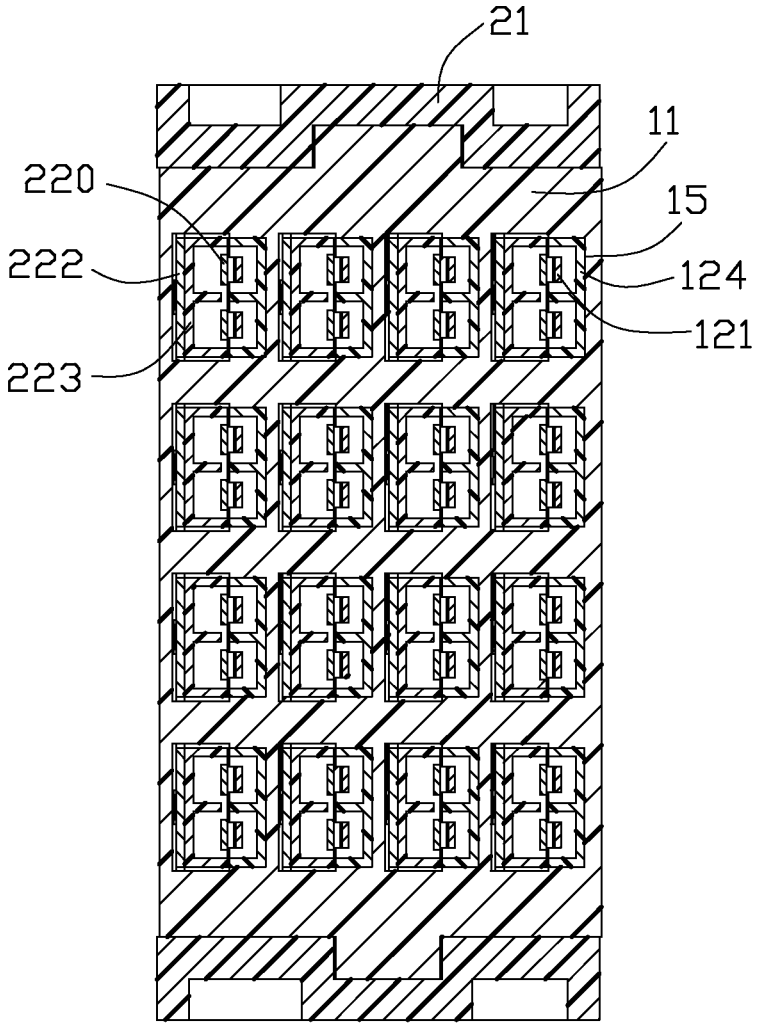
FIG. 2 is a cross-section view of the electrical connector system when cut in a line II-II shown in FIG. 1.
Figure 3:
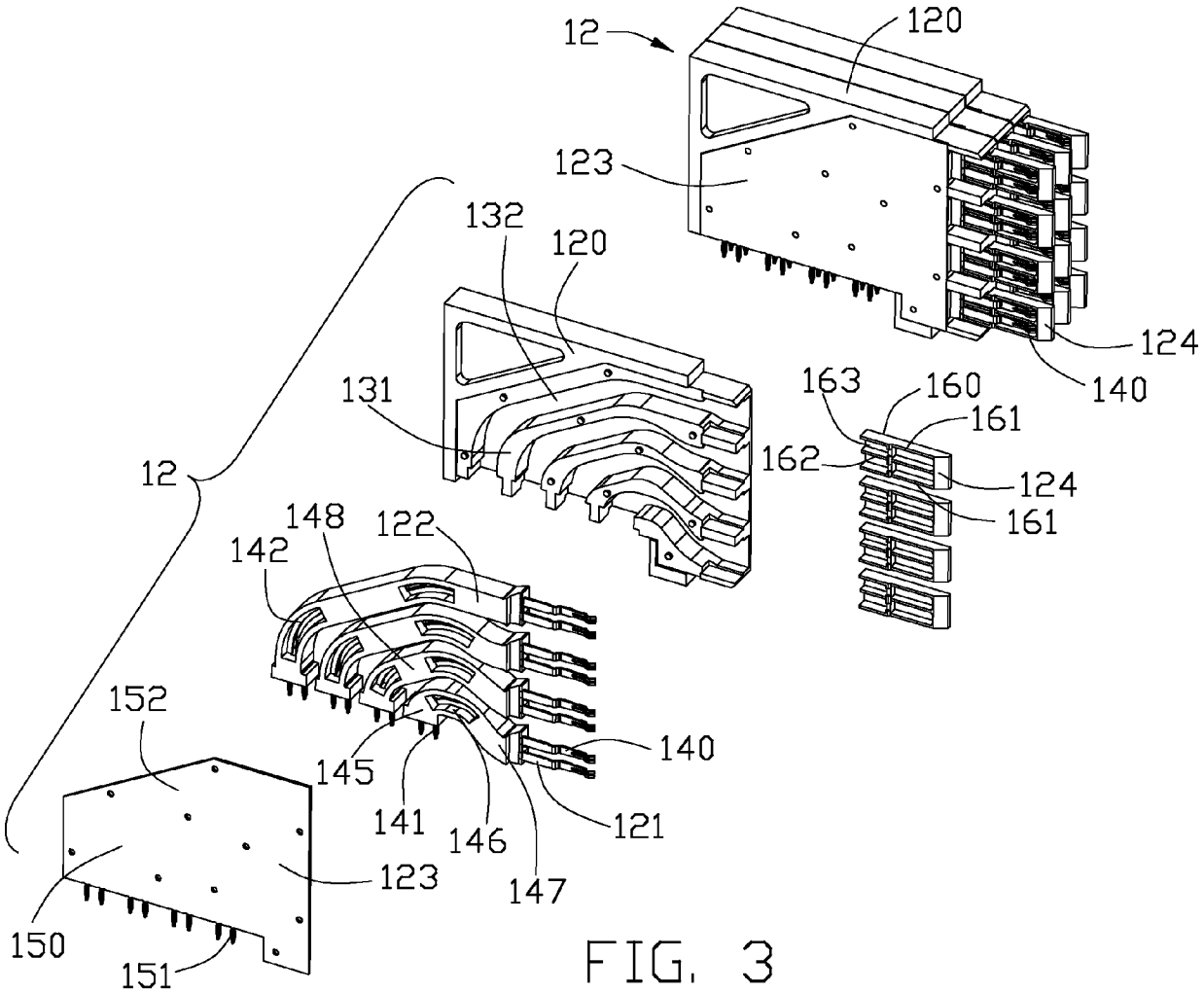
FIG. 3 is a perspective view of the stacked contact wafers with one contact wafer being exposed shown in FIG. 1.
Figure 4:
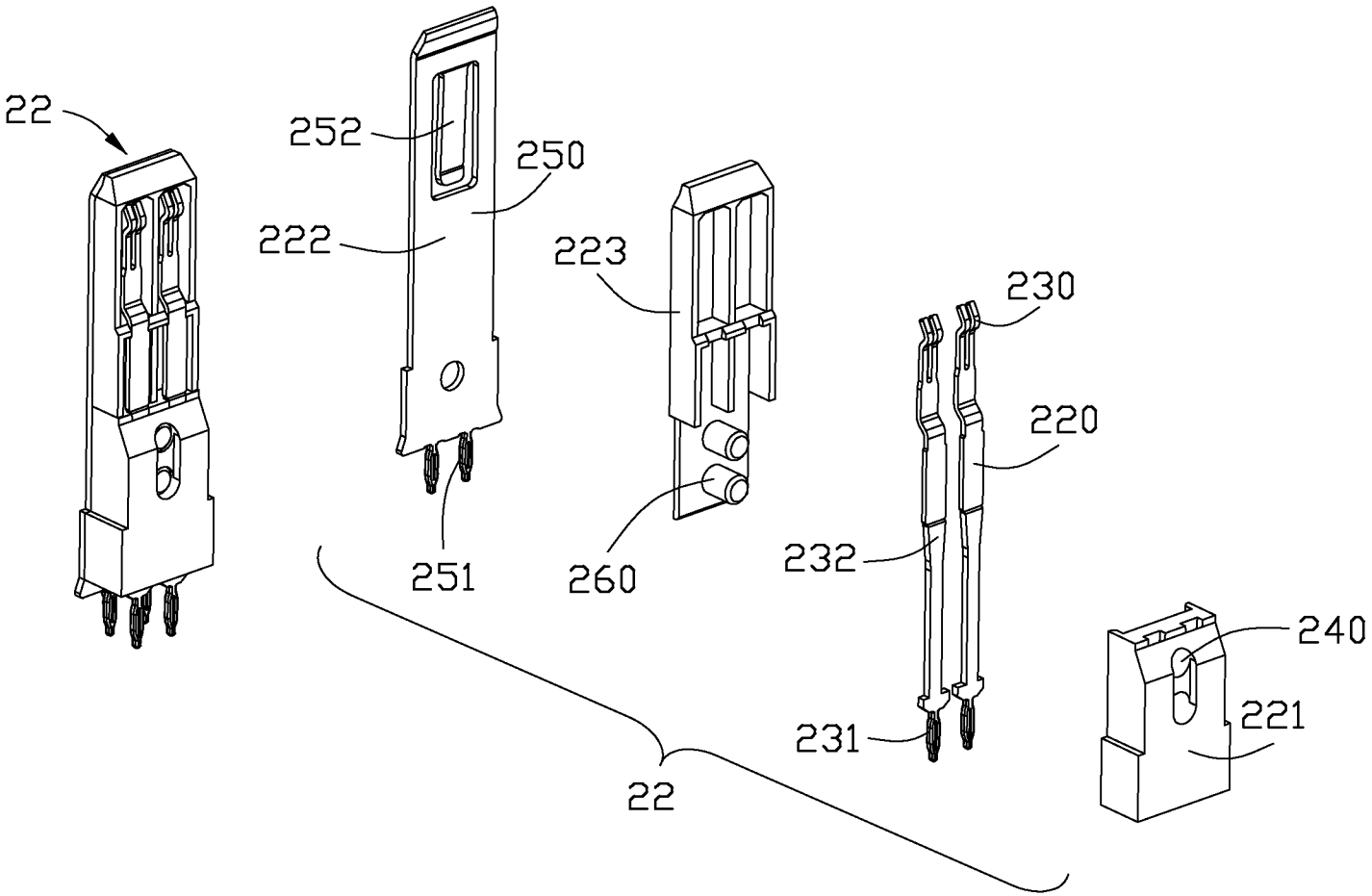
FIG. 4 is a perspective view of two contact modules shown in FIG. 1, one in assembled condition and the other in exposed condition.

Reference will now be made to the drawing figures to describe the present invention in detail.

FIGS. 1-4 show a connector assembly according to a first embodiment of present invention. The connector assembly 1 is shown to connect a daughter card (not shown) to a backplane (not shown). The connector assembly 1 includes a plug 10 mounted onto the daughter card and a header 20 mounted onto the backplane.

The plug 10 includes a conductive front housing 11 and a number of contact wafers 12 stacked along a transverse direction and mounted to a rear face of the front housing 11. The plug 10 defines a mounting face 17 adapted to be mounted onto the daughter card. The header 20 includes a mounting face 27 adapted to be mounted onto the backplane.

The front housing 11 is made from die casting metal or conductive plastic, or insulating piece plated with metal plating. In a preferred embodiment, the front housing 11 is made from thermoplastic plated with metal plating, such as Chromium, Copper, Tin and Gold. The front housing 11 defines a front face 13 forwardly facing the header 20, a rear face 14 opposite to the front face 13 and a number of holes 15 extending through the rear face 14 and the front face 13.

Each of the wafers 12 includes a conductive board 120 defining mutual opposite first face and second face, four pairs of first signal contacts 121, four first insulating holders 122 respectively fixing the pairs of first signal contacts 121, a first shielding plate 123, and four first insulating protectors 124 assembled to the conductive board 120. Each pair of first signal contacts 121 are insert-molded with one corresponding first insulating holder 122 to form a contact module (not labeled), and thus there are four contact modules in each wafer 12 in each wafer 12. The first shielding plate 123 has a planar portion 150 and eight grounding feet 151 extending downwardly from the planar portion 150. The conductive board 120 is electrically connected to the first shielding plate 123 and connected to the daughter card through grounding feet 151 of the first shielding plate 123. The metal shielding plate 123 is added to keep the insulating holders 122 from being extruding out from the conductive board 120 when the plug 10 is mounted onto the daughter card and further improve shielding performance.

The conductive board 120 defines four slots 132 in the first face respectively receiving corresponding contact modules and three isolating walls 131. Each of the first contacts 121 includes a deflectable contacting portion 140 received in the front housing 11, a foot portion 141 extending out from the conductive board 120, and an intermediate portion 142 connecting the contacting portion 140 and the foot portion 141. Differential signals are transferred in the contact pair 121 in each slot 132 of the conductive board 120.

The conductive board 120 is made from die casting metal or conductive plastic, or insulating piece plated with a metal plating. In a preferred embodiment, the conductive board 120 is made from thermoplastic with a high melt point above 300 degrees Celsius, and plated with metal plating such as Chromium, Copper, Tin and Gold. Comparing to the second region made of a material with a binder containing conductive fillers to provide shielding between signal conductors, which disclosed in U.S. Pat. No. 6,709,294 B1 by Cohen et al. on Mar. 23, 2004, the plated conductive board 120 in present invention more perfectly provides shielding between adjacent wafers 12 and decreases crosstalk between adjacent contact pairs 121 received in the same wafer 12. Further more, the contact modules are inserted into the slots 132 of the conductive board 120, so there is no need to insert-mold the first insulating holders 122 into the slots 132 of the conductive board 120, which decreases potential risk of destroying the metal plating of the conductive board 120.

Each of the first insulating protector 124 includes a base board 126, a pair of side walls 161, an intermediate wall 162, and a pair of cavities 163 for receiving the contacting portions 140 of corresponding pair of first contacts 121. The first insulating protectors 124 has front ends received in the front housing 11 and rear ends received in the conductive boards 120. The cavities 163 of the insulating protectors 124 and the slots 132 open to a same side in the transverse direction. The contacting portion 140 is sheltered by the first insulating protector 124 such that the contacting portion 140 is deflectable only in the transverse direction away from the first shielding plate 123 towards the conductive board 120.

The header 20 includes a conductive shroud 21 and a number of contact modules 22 arrayed in the conductive shroud 21. The conductive shroud 21 is made from die casting metal or conductive plastic, or insulating piece plated with metal plating. In a preferred embodiment, the conductive shroud 21 is made from thermoplastic, and plated with metal plating such as Chromium, Copper, Tin and Gold. The shroud 21 includes a bottom wall 23, two upwardly extending side walls 24 and a receiving space 25 defined therebetween for receiving a portion of the plug 10. The bottom wall 23 defines an array of holes 26 each receiving one of the second contact modules 22.

Each of the contact module 22 includes a pair of second contacts 220, a second insulating holder 221 insert-molded with the pair of second contacts 220, a second shielding plate 222 assembled to the second insulating holder 221, and a second insulating protector 223. The second insulating holder 221 and the second insulating protector 223 are used to fix the pair of second contacts 220 and keep them isolated from the second shield 222.

Each of the second contacts 220 includes a deflectable contacting portion 230 inserted into corresponding holes 15 of the plug 10, a foot portion 231 extending downwardly for mounting onto the backplane, and an intermediate portion 232 connecting the contacting portion 230 to the foot portion 231. The intermediate portion 232 is embedded in the second insulating holder 221 and isolated from the conductive shroud 21.

Each second insulating holder 221 of the header 20 defines two positioning holes 240. The second shielding plate 222 including a planar board portion 250, a pair of ground feet 251, and a flexible contacting arm 252 punched from the board portion 250 and extending towards the ground feet 251. The second insulating protector 223 forms a pair of positioning posts 260 interference fitting with the two position holes 240 of the second insulating holder 221. The conductive shroud 21 is electrically connected to the second shielding plates 222 and further electrically connected to the backplane through the grounding feet 251 of the second shielding plates 222.

It should be understandable that when the plug 10 is mated with the header 20, the conductive boards 120 make electrical connection with the conductive shroud 21, and the contacting portions 252 of the second shielding plates 222 contact the front housing 11 of the plug 10. It should be also understandable that the signal routing path, which extends from the foot portions 231 of the second contacts 220 to the foot portions 141 of the first contacts 121, is completed shielded in all direction perpendicular to the signal routing path. Furthermore, the filling degree of the insulating holders 122 in one of the slots 132 varies along the signal path in such manner that the pair of the first contacts 121 are fixed to the conductive board 120 by two or three parts 145, 147, 148 of the insulating holders 122 along part lengths of the signal path, and part 146 of the first contacts 121 along part lengths of the signal path is exposed to the air.

Figure 5:
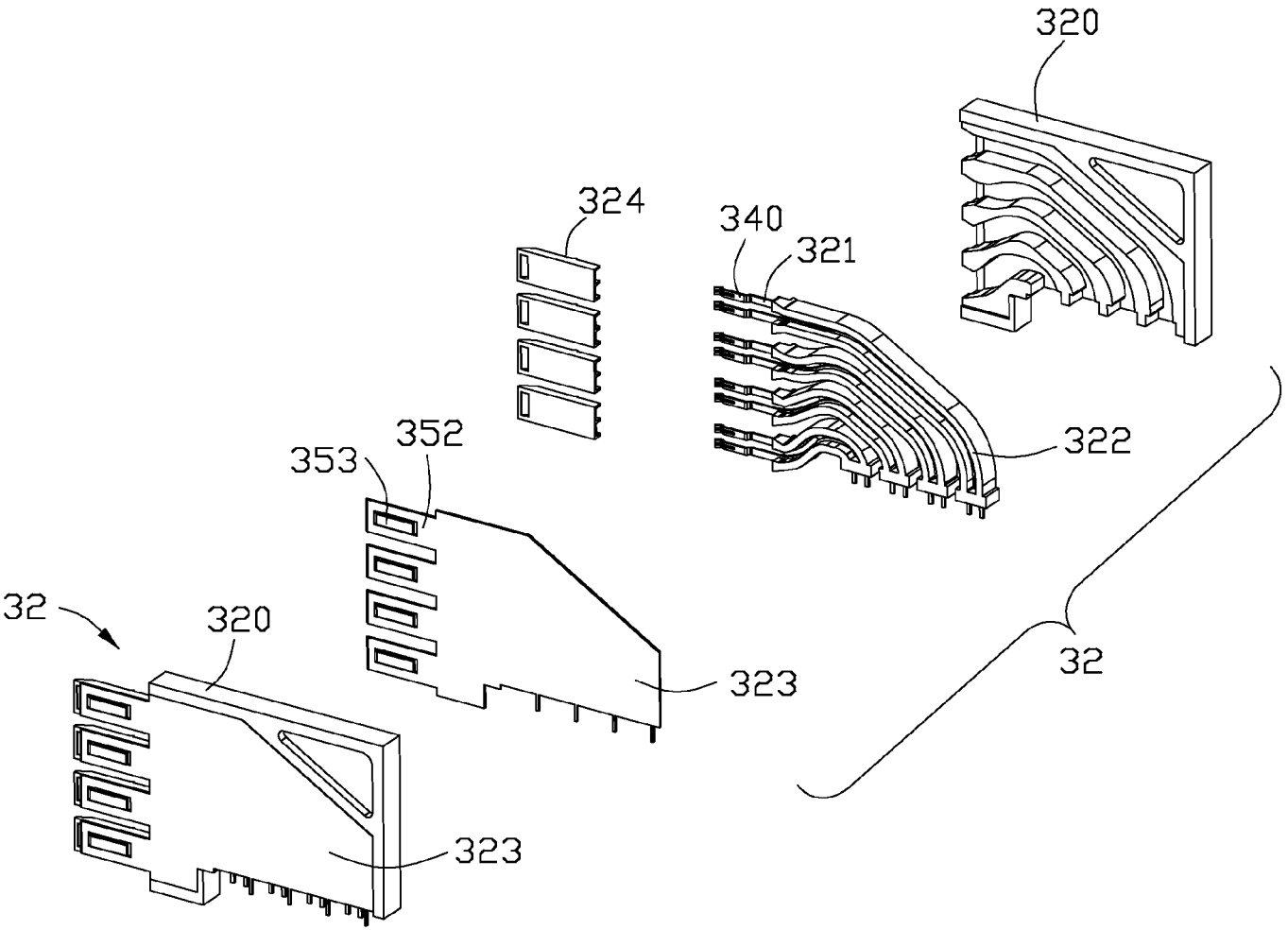
FIG. 5 showing two contact wafers of a plug according to a second embodiment of the present invention, one in assembled condition and the other in exposed condition.
Figure 6:
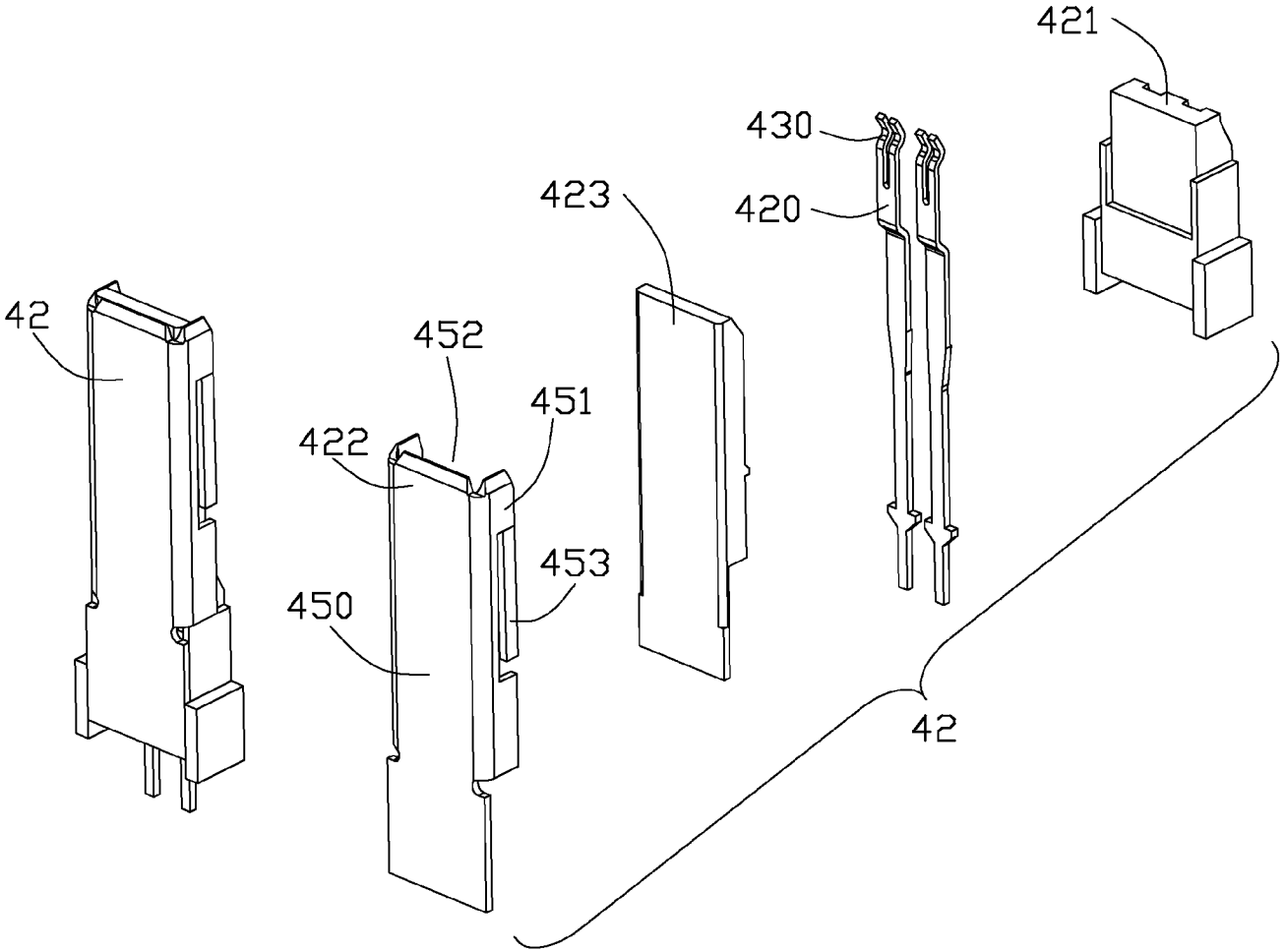
FIG. 6 showing two contact modules of a header according to a second embodiment of the present invention, one in assembled condition and the other in exposed condition.

Referring to FIGS. 5 and 6, an electrical connector assembly 2 according to a second embodiment of the present invention is shown. The electrical assembly 2 has a plug (not shown) and a header (not shown) similar to the electrical connector assembly 1 except contact wafers 32 of the plug and the contact modules 42 of the header. Each of the contact wafers 32 has a conductive board 320, four pairs of third contacts 321, four third insulating holders 322, four third insulating protectors 360, and a third shielding plate 323. A first difference for the contact wafer 32 is that the shielding plate 323 has four flat tab portions 352 forwardly extending beyond a front edge of the conductive board 320, and each of the tab portions 352 forming a flexible contacting arm 353. A second difference for the contact wafer 32 is that the third insulating protectors 324 are disposed between the contacting portions 340 and the tab portions 352, and the third contacts 321 have contacting portions 340 deflectable in the transverse direction towards the tab portions 352 of the third shielding plate 323. Each of the fourth contact modules 42 has a fourth shielding plate 422, a fourth insulating protector 423, a pair of fourth contacts 420, a fourth insulating holder 421. The main difference for the contact module 42 is that the fourth shielding plate 422 has a board portion 450, two side walls 451 to define a U-shaped receiving slot 452 therebetween, and two flexible contacting arms 453 in the two side walls 451, and the fourth insulating protector 423 is secured in the U-shaped slot 452 to isolate contacting portions 430 of the fourth contacts 420 from the fourth shielding plate 422.

Referring to FIGS. 7-11, an electrical connector assembly 3 according to a third embodiment of present invention is shown. The electrical connector assembly 3 has a plug 50 and header 60 similar to the first embodiment. The plug 50 includes a number of contact modules 502 stacked in a transverse direction and five grounding belts 53 connecting the contact modules 502. Each of the contact modules 502 comprises a conductive board 51, four contact modules 52 each having a pair of fifth contacts 551 and a fifth insulating holder 550 insert-molded with the pair of contacts 551, and four insulating protectors 54. Each of the conductive boards 51 defines a first face with a plurality of slots 562 defined therein and an opposite second face with three slits 565 defined therein. The conductive board 51 has three inner walls 561 and three ribs 564. Each of the inner walls 561 is located between every two adjacent slots and each of the ribs 564 protruding from one of the inner walls 561. The contact modules 52 are received in respective slot 562.

When the contact modules 502 are transversely stacked, the ribs 564 mate into corresponding slits 565 of an adjacent contact module 502 to make complete shielding between adjacent fifth contact pairs 551, and the conductive boards 51 jointly define a mounting face 57 to be mounted onto a daughter card (not shown), and a front face 58. The front face 58 forms a plurality of holes 580 therein to receive contacts 620 of the complimentary header 60. Each of the holes 580 formed by one slot 562 of said conductive board 51 and an adjacent conductive board 51.

Each of the fifth contacts 551 has a foot 553, a deflectable contacting portion 552 and an intermediate portion 554 connecting the foot 553 and the contacting portion 551. The contacting portions 552 and the intermediate portions 554 of each contact pair 551 are received in corresponding slot 562, and the feet 553 extending perpendicularly from the mounting face 57.

Each of the insulating protectors 54 is received in the holes 580 and between the contacting portions 552 of corresponding pairs of fifth contacts 551 and the bottom wall of corresponding slot 562. The contacting portions 552 are deflectable in the transverse direction towards the bottom wall of corresponding slot 562 and front ends of the contacting portion 552 are sheltered by the insulating protector 54. The main difference for the header 50 comparing the header 10 of the first embodiment is that there is no conductive housing 11 and no first shielding plate 123.

Figure 10:
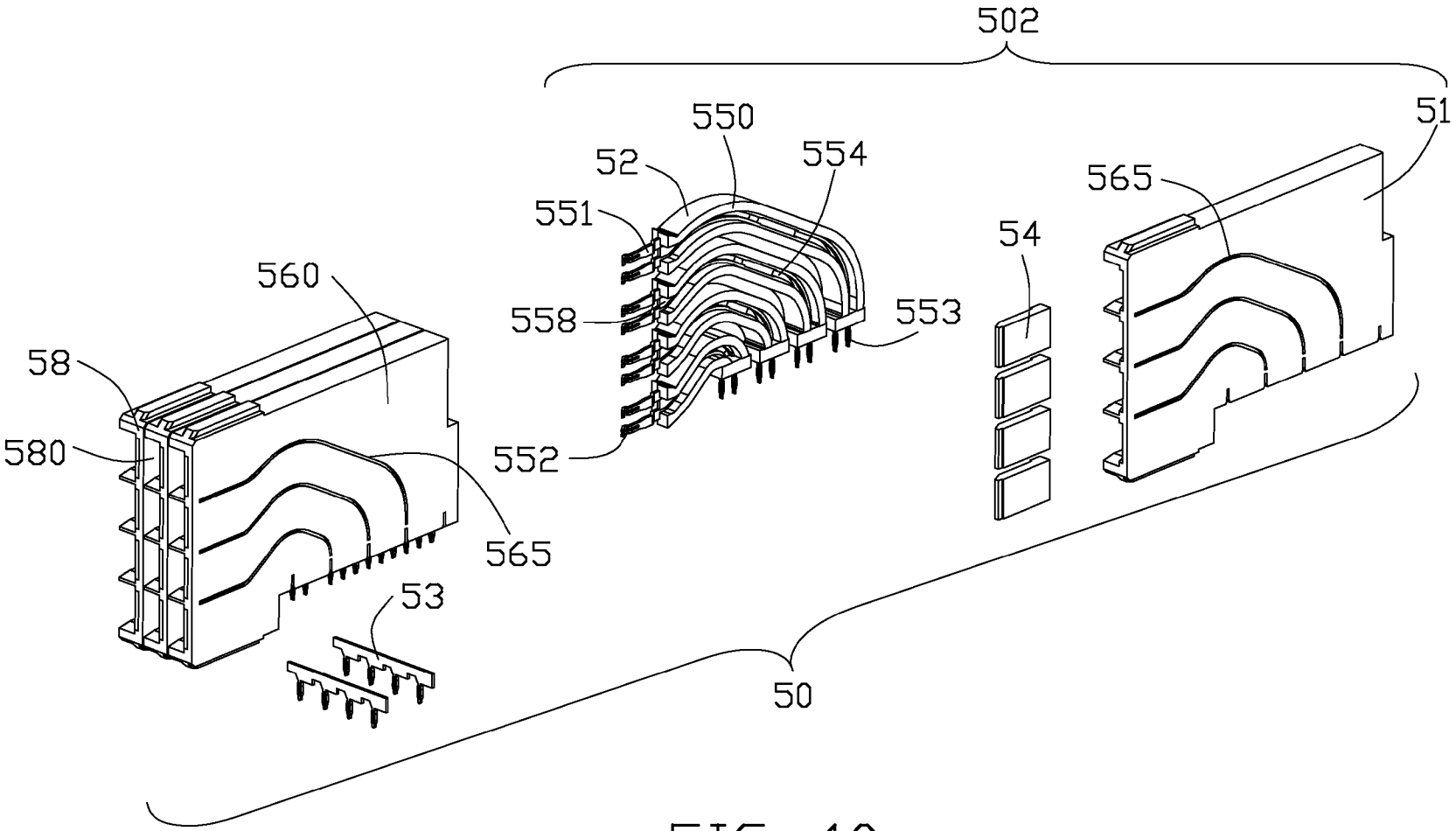
FIG. 10 is a partially exploded view of a plug shown in FIG. 7.
Figure 11:
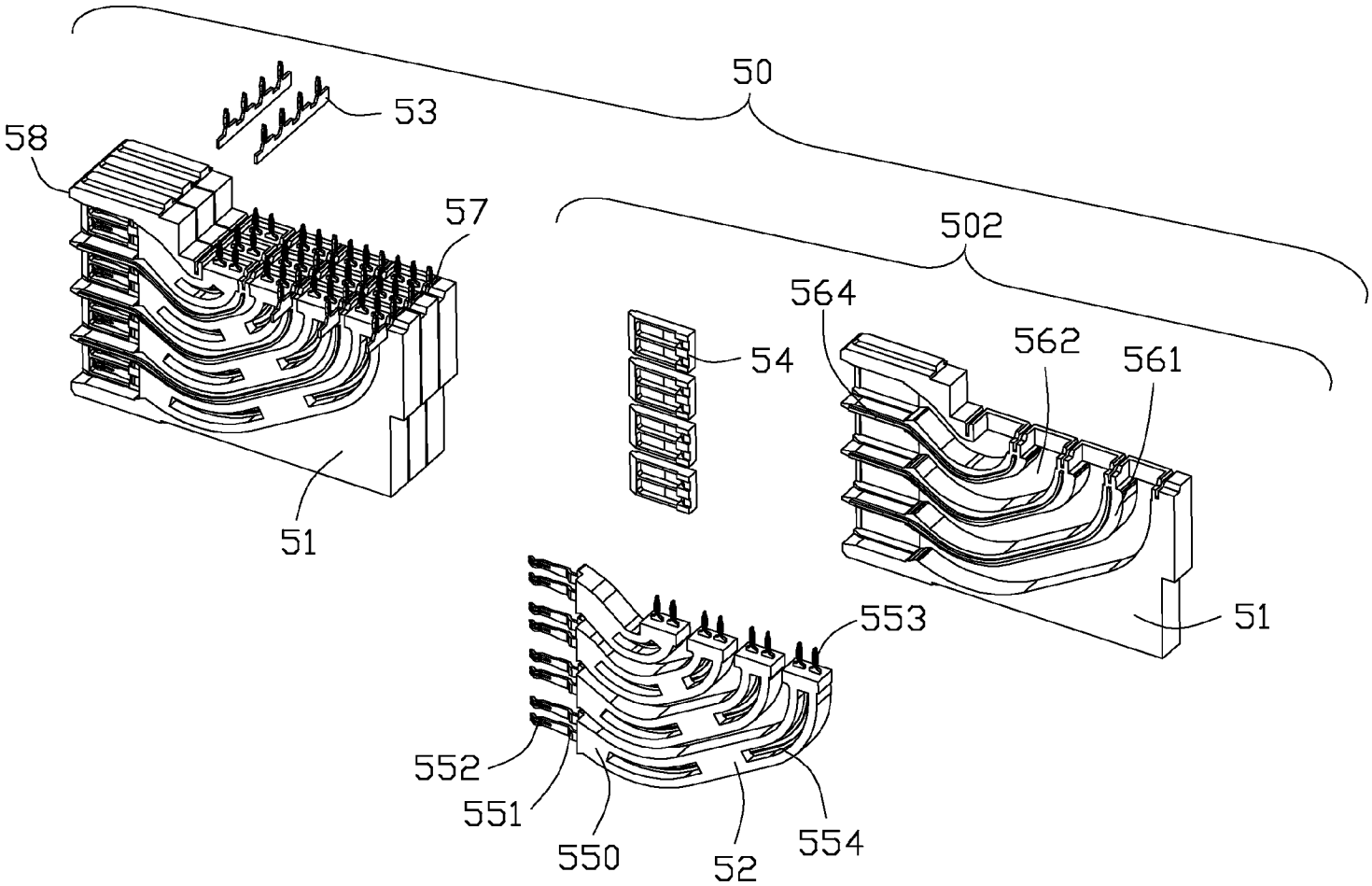
FIG. 11 is another partially exploded view of the plug shown in FIG. 7 in a different viewpoint.

Jointly referring to FIGS. 10 and 11, similar to the first embodiment, the filling degree of the fifth insulating holders 550 in one of the slots 562 varies along the signal path in such manner that the pair of the first contacts 551 are fixed to the conductive board 51 by one of the fifth insulating holders 550 along part lengths of the signal path, and at least part of the first contacts 551 along part lengths of the path is exposed to the air. It is further shown that the part of insulating holder 52 near the contacting portion 552 defines a slot 558 to change the dielectric disposed around the fifth contact pair 551, which make the impedance to the signal in the fifth contact pair 551 approaching a constant along the signal path.

Figure 7:
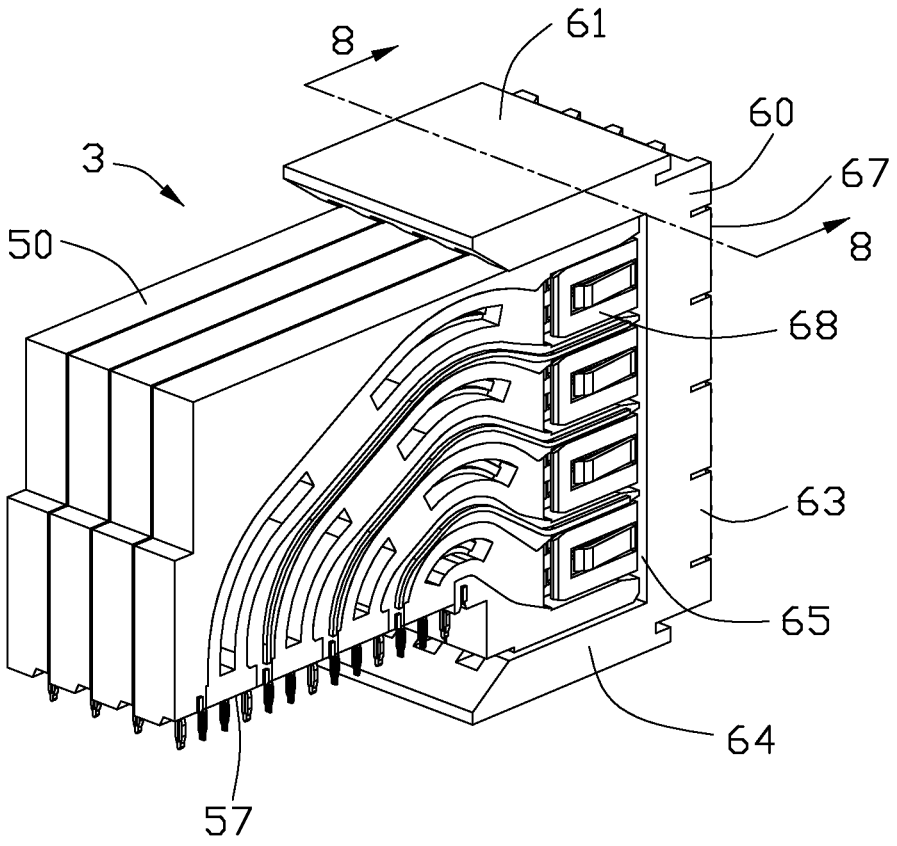
FIG. 7 is a perspective view of a connector assembly of according to a third embodiment of the present invention.
Figure 8:
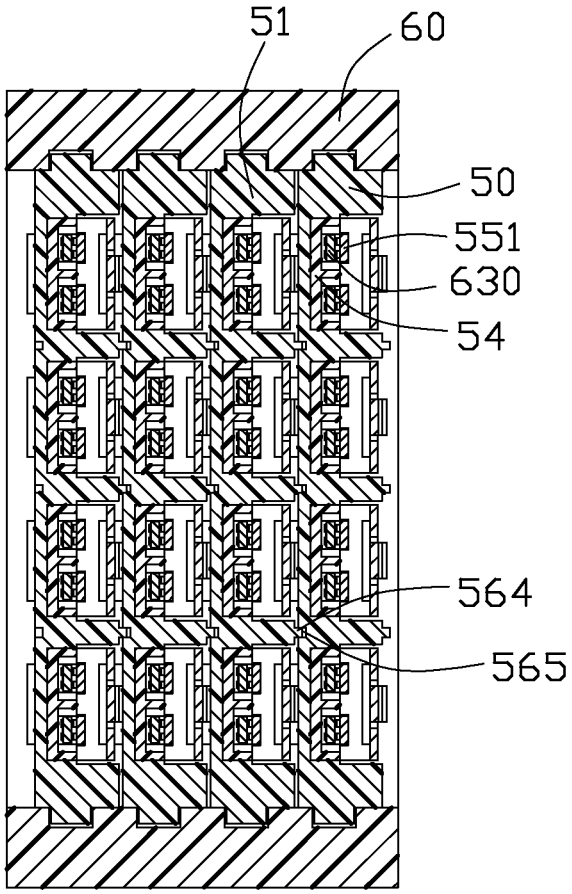
FIG. 8 is a cross-section view of the electrical connector system when cut in the line VIII-VIII shown in FIG. 7.
Figure 9:
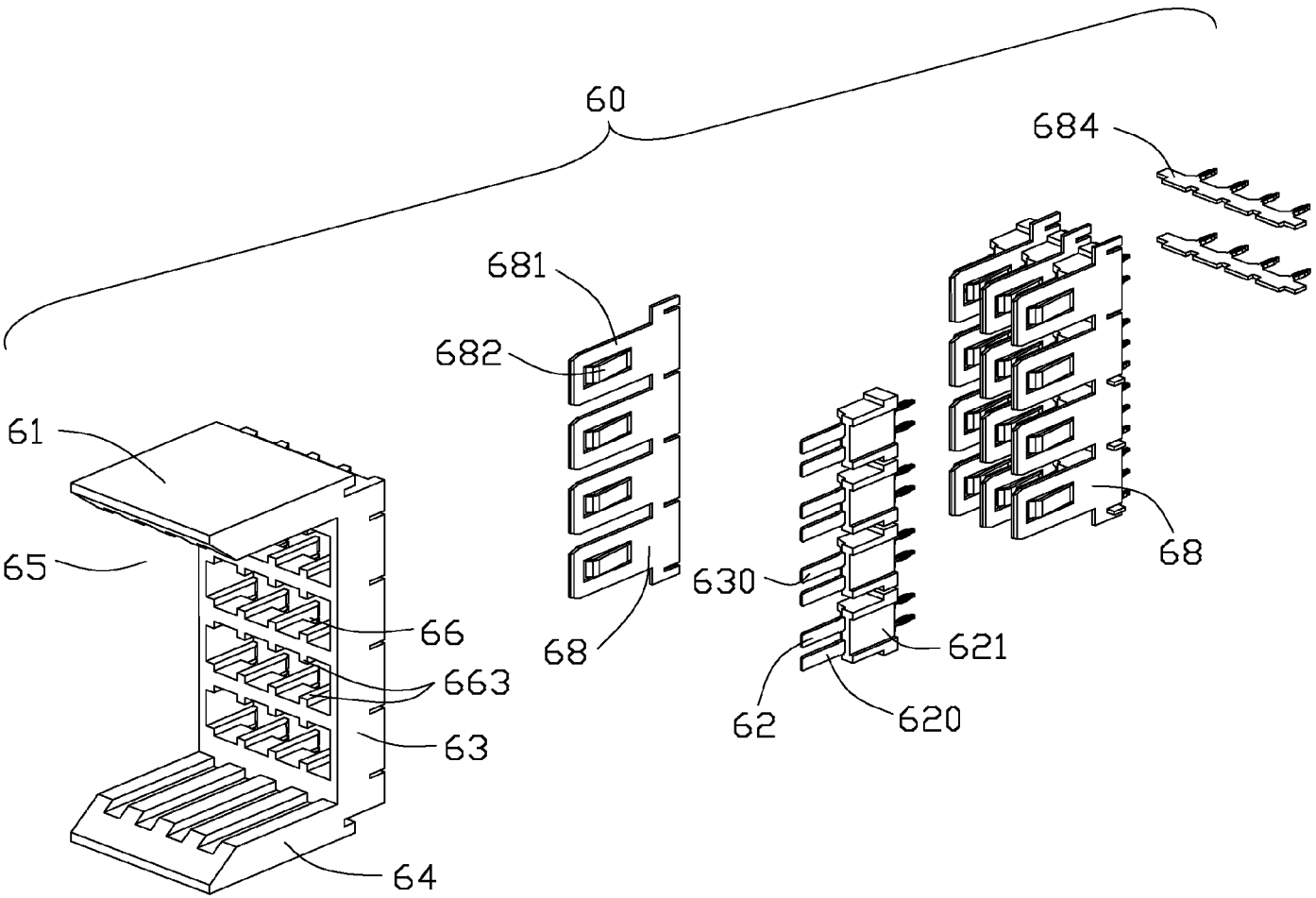
FIG. 9 is a partially exploded view of a header shown in FIG. 7.

Referring to FIGS. 7-9, the header 60 includes a conductive shroud 61, sixteen pairs of sixth contact modules 62, four sixth shielding plates 68, and five grounding belts 684. Each of the sixth shielding plates 68 has four flat tabs 681 and four flexible contacting arms 682. Each of the sixth contact modules 62 includes an insulating holder 621 and a pair of sixth contacts 620. Each of the sixth contacts 620 has a non-deflectable contacting portion 630. The conductive shroud 61 includes a bottom wall 63, two upwardly extending side walls 64 and a receiving space 65 defined therebetween for receiving a portion of the plug 50. The bottom wall 63 of he conductive housing 61 defines four through holes 66 each having pairs of ribs 663 protruding from opposite inner faces of the holes 66, the pairs of ribs 663 dividing each of the holes 66 into four receiving spaces to receive one of the contact modules 62 and corresponding tab 681 of the shielding plates 68.

The differences for the header 60 comparing to the first embodiment is listed as below: (1) there is no insulating protector between the tabs 681 of the shielding plates 68 and the contacting portions 630, which improve the impedance of the contact pair; (2) each hole 66 of the shroud 61 receive four sixth contact modules 62 and corresponding flat tabs 681 stacked in a column direction; (3) four flat tabs 681 corresponding to each contact module 62 are integrally formed in the sixth shielding plate 68 extending in a row direction; (4) there are grounding belts 684 extending along the column direction and connecting the sixth shielding plate 68 and the conductive shroud 61 to the backplane.

Figure 12:
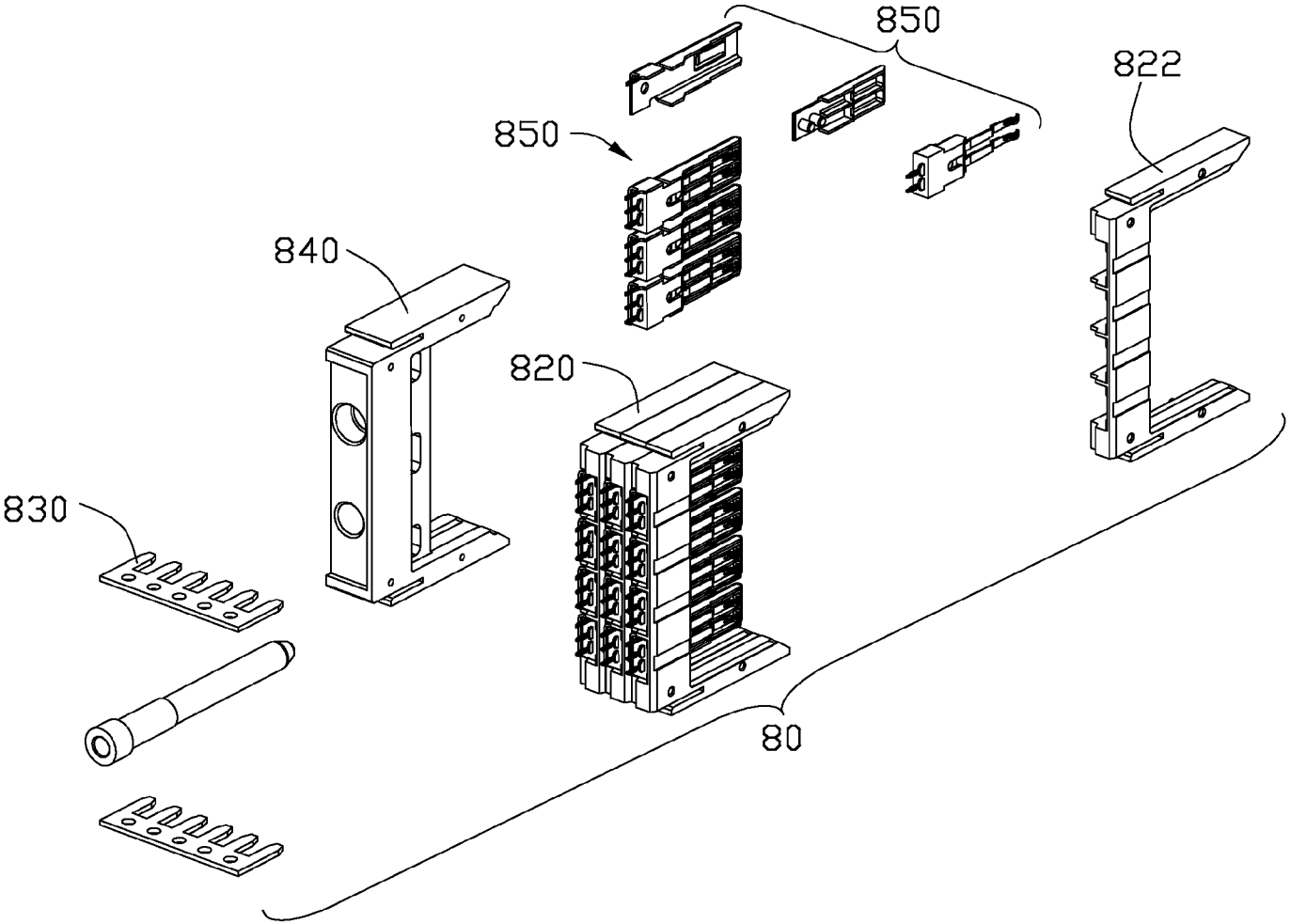
FIG. 12 is a partially exploded view of a header of a connector assembly according to a fourth embodiment of the present invention.
Figure 13:
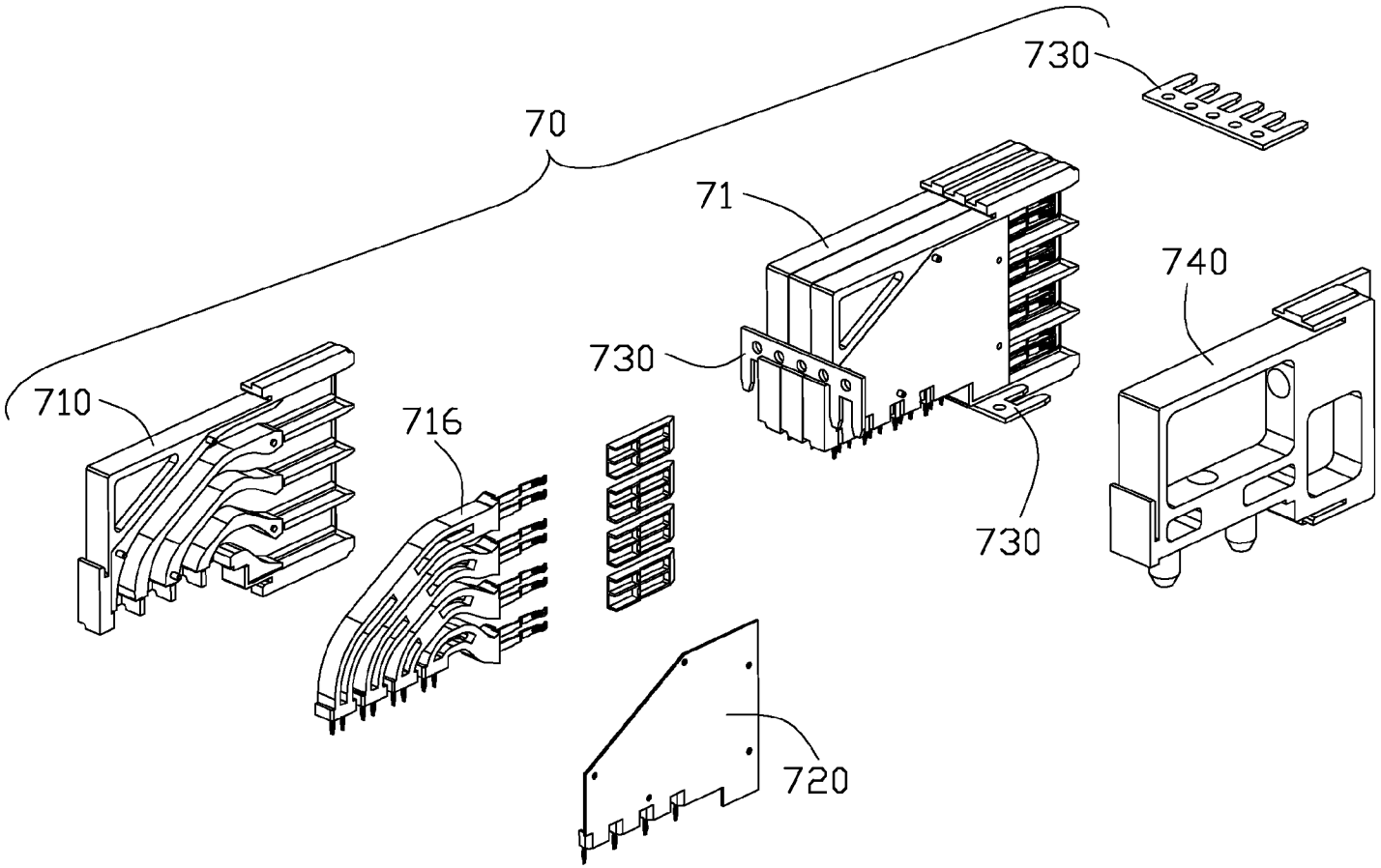
FIG. 13 is a partially exploded view of a plug of a connector assembly according to the fourth embodiment of the present invention.

Referring to FIGS. 12-13, a connector assembly according to a fourth embodiment is shown. The connector assembly includes a plug 70 and a header 80. The header 80 includes four contact wafers 820 and a guide wafer 840 stacked in a transverse direction, and two sawtooth organizers 830 latching opposite sides of the wafers 820, 840. Each of the contact wafers 820 includes a conductive board 822 and four contact modules 850. Each of the contact modules 850 has similar structure to aforementioned contact module 42. The plug 70 includes four contact wafers 71 and one guide wafer 740 stacked in a transverse direction, and three organizers 730 latching the wafers 71, 740. The metal shielding plate 720 is added to keep the contact module 716 from being extruding out from the conductive board 710 when the plug 70 is mounted onto the daughter card and further improve shielding performance.

Figure 14:
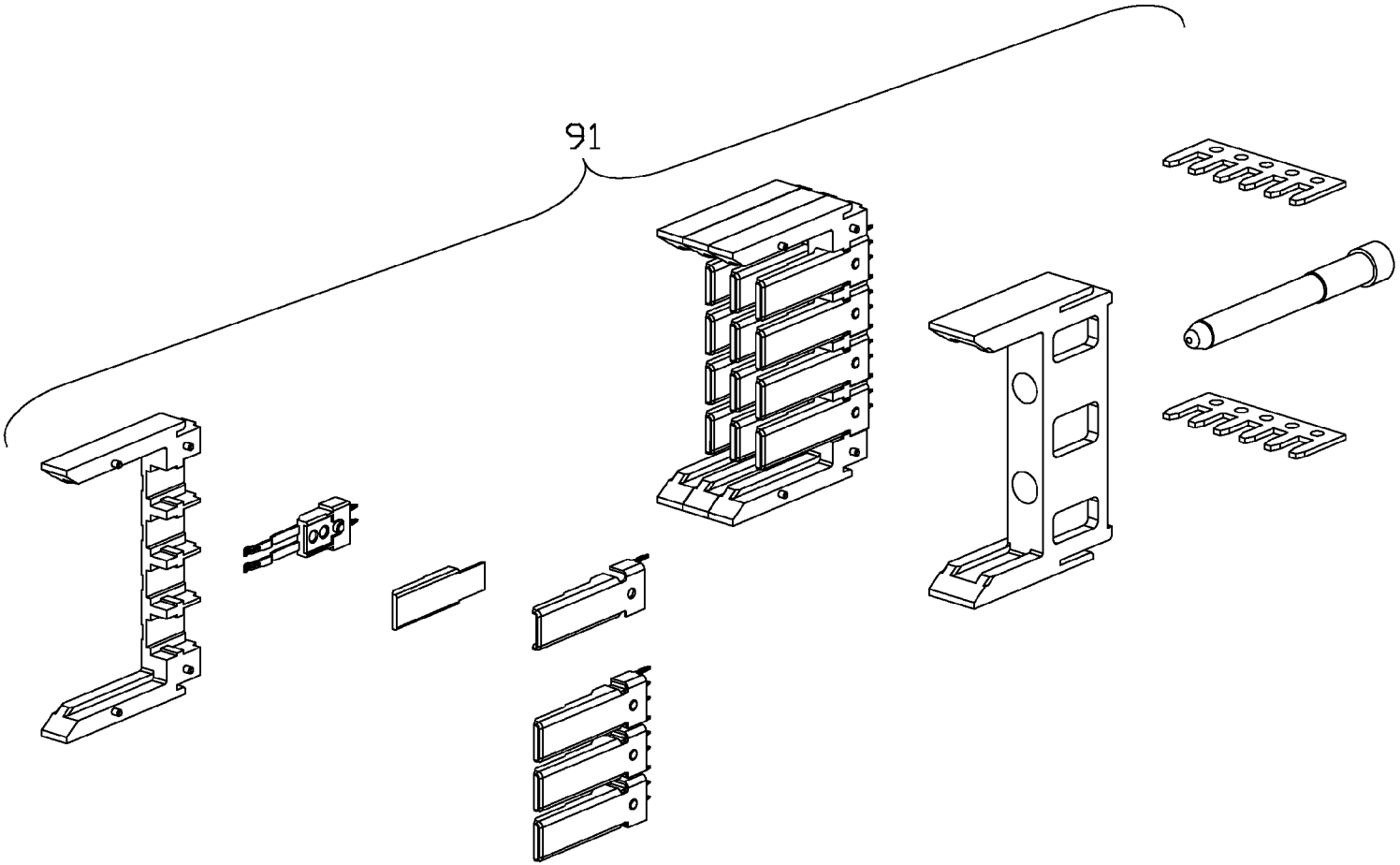
FIG. 14 is a partially exploded view of a header of a connector assembly according to a fifth embodiment of the present invention.
Figure 15:
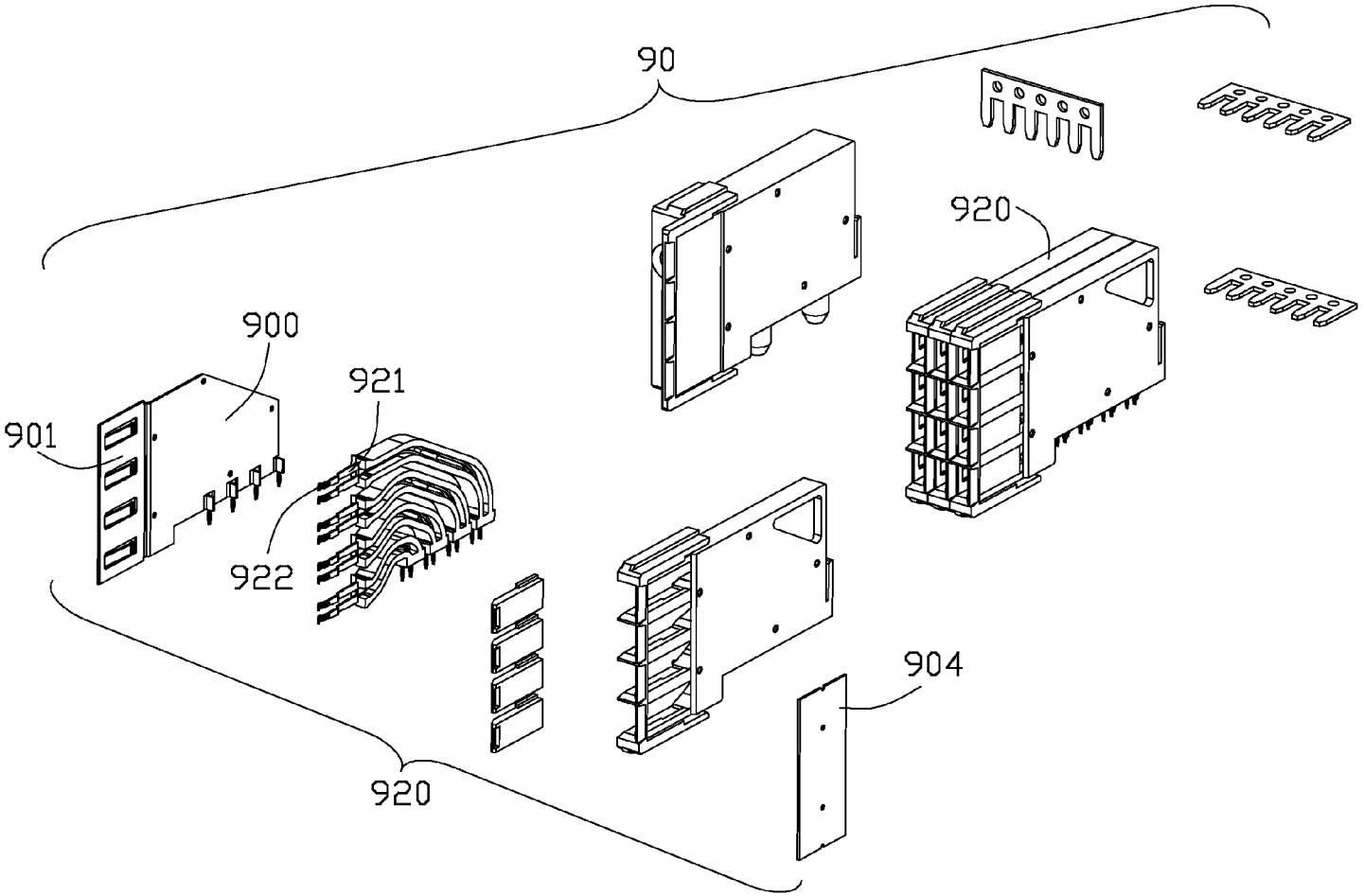
FIG. 15 is a partially exploded view of a plug of a connector assembly according to the fifth embodiment of the present invention.

Referring to FIGS. 14-15, a connector assembly according to a fifth embodiment is shown. The connector assembly includes a plug 90 and a header 91. The header 91 has similar structure to the aforementioned header 80. The plug 90 has similar structure to the aforementioned plug 70 except that each contact wafer 920 adds two contacting plates 901, 904 extending across four pairs of contacts 921 aside the contacting portions 922 to improve shielding performance and mating durability, wherein the contacting plate 901 is integral with a shielding plate 900 covering aside the contact wafer 920.

Figure 16:
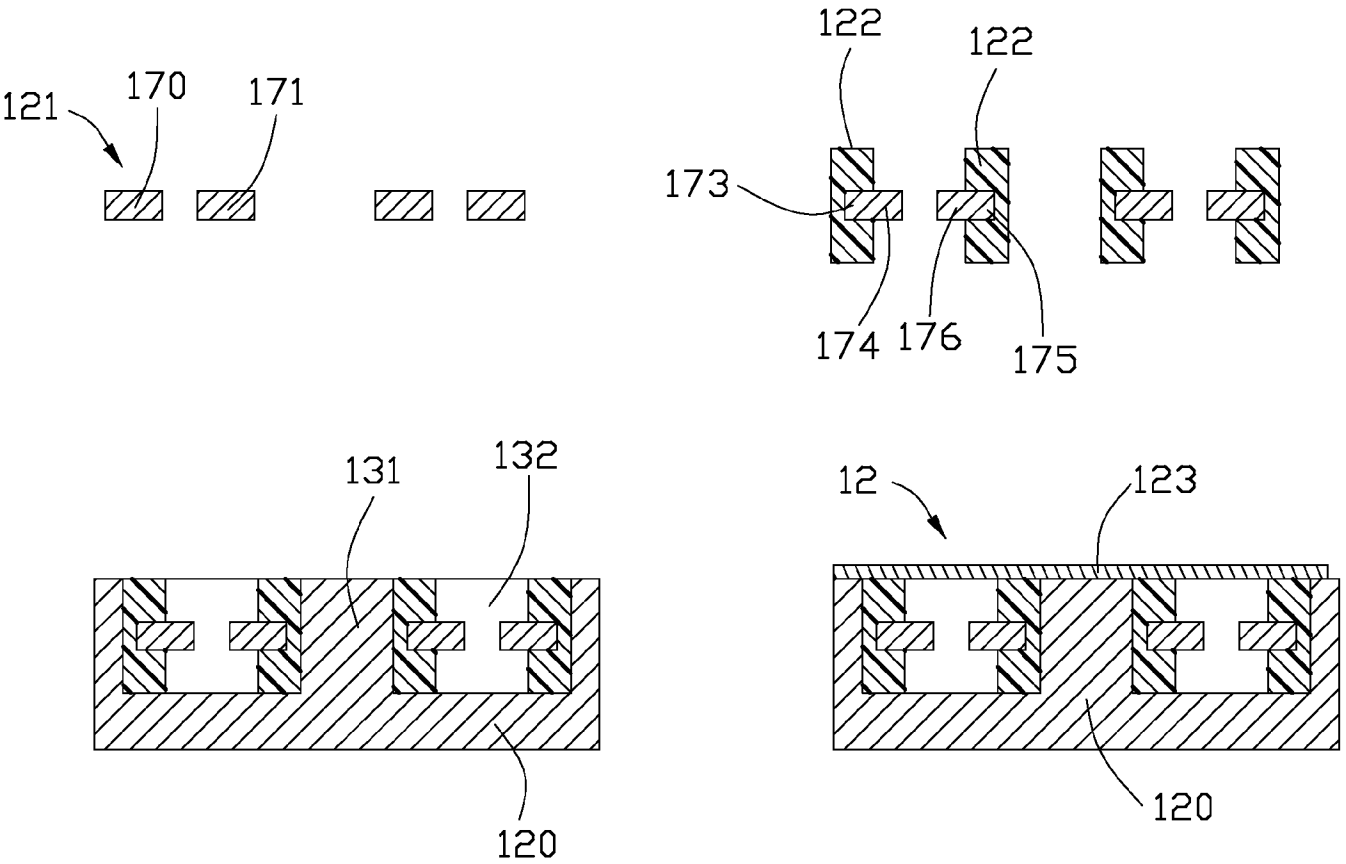
FIG. 16 showing a first method of making the contact wafer shown in FIG. 1.

Referring to FIG. 16, a method for making the contact wafer 12 of the plug 10 is shown. The method includes the following steps: (1) punching a metal strip to form a contact pair 121 including a left contact 170 and a right contact 171, the left contact 170 and the right contact 171 being carried in a planar in an edge-to-edge manner; (2) insert-molding the contact pair 121 into an insulating holder 122 with a left edge 173 of the left contact 170 and a right edge 175 of the right contact 171 embedded in the insulating holder 122, and a right edge 174 of the left contact 170 and a left edge 176 of the right contact 171 exposed to air; (3) assembling the contact module formed in step (2) into a slot 132 of a conductive board 120; (4) covering a shielding plate 123 over a side of the conductive board 120. Jointly referring to FIG. 3, it could also be described that each pair of contacts 170, 171 are kept in a planar surface with near edges 174, 176 facing to each other and far edges 173, 175 backing away from each other, the far edges 173, 175 of the intermediate portions embedded in the first insulating holder 122 and the near edges 174, 176 of the intermediate portions exposed to air in part length of the signal path, which make the pair of contacts 170, 171 firmly fixed by the first insulating holders 122, and at the same time there is void between the near edges 174, 176 to improve the impedance of the contact pair 170, 171.

Figure 17:
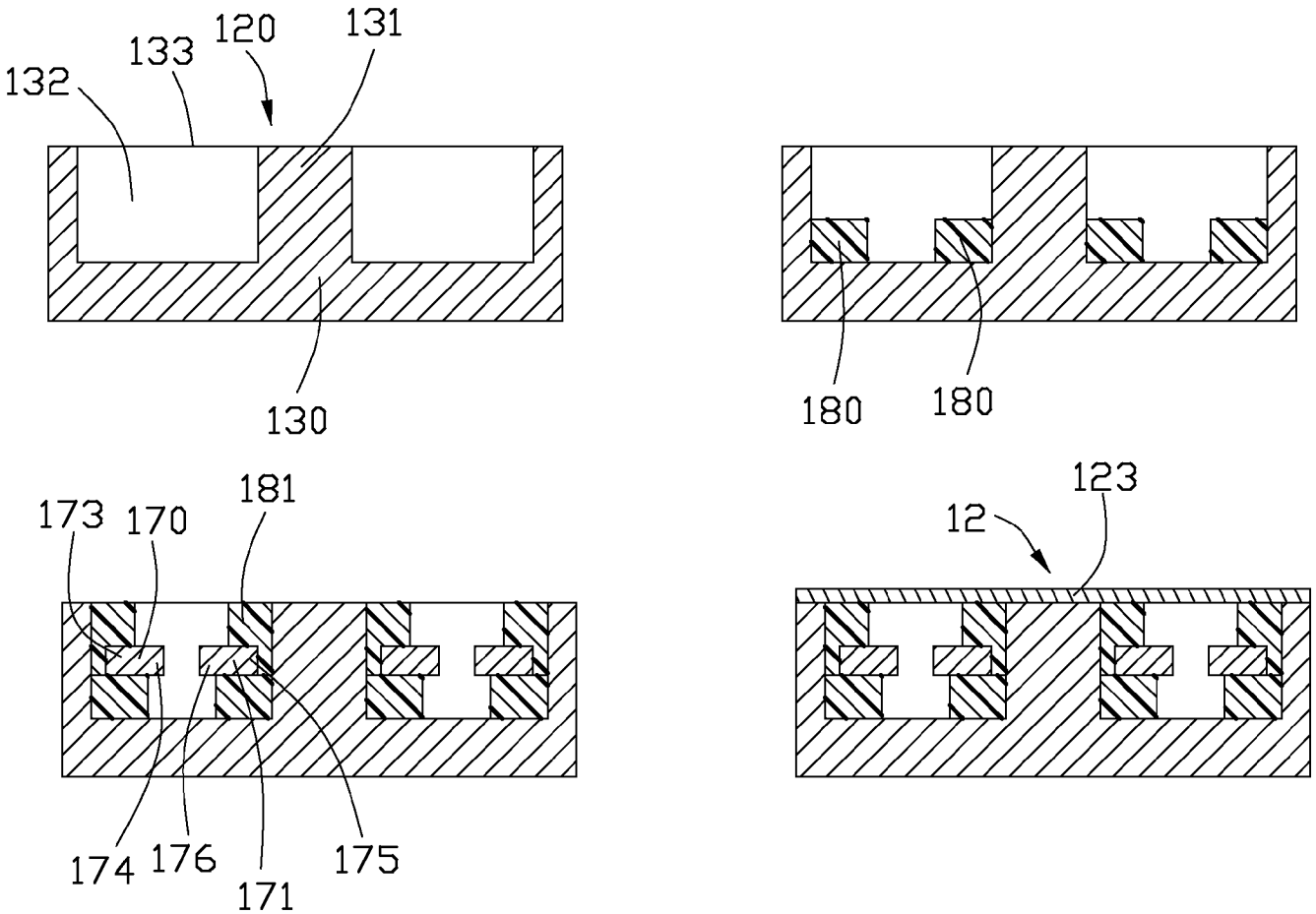
FIG. 17 showing a second method of making the contact wafer shown in FIG. 1.

Referring to FIG. 17, a second method for making the contact wafer 12 is shown. The method includes the following steps: (1) providing a conductive board 130 having slots 132 therein; (2) insert-molding a first plastic 180 on a bottom wall of the slot 132; (3) putting a contact pair 170, 171 punched from a metal strip into the slot 132 and on the first plastic 180, and insert-molding a second plastic 181 in the slot 132 on the first plastic 180 and the contact pair 170, 171; (4) covering a shielding plate 123 over a side of the conductive board 120.

Figure 18:
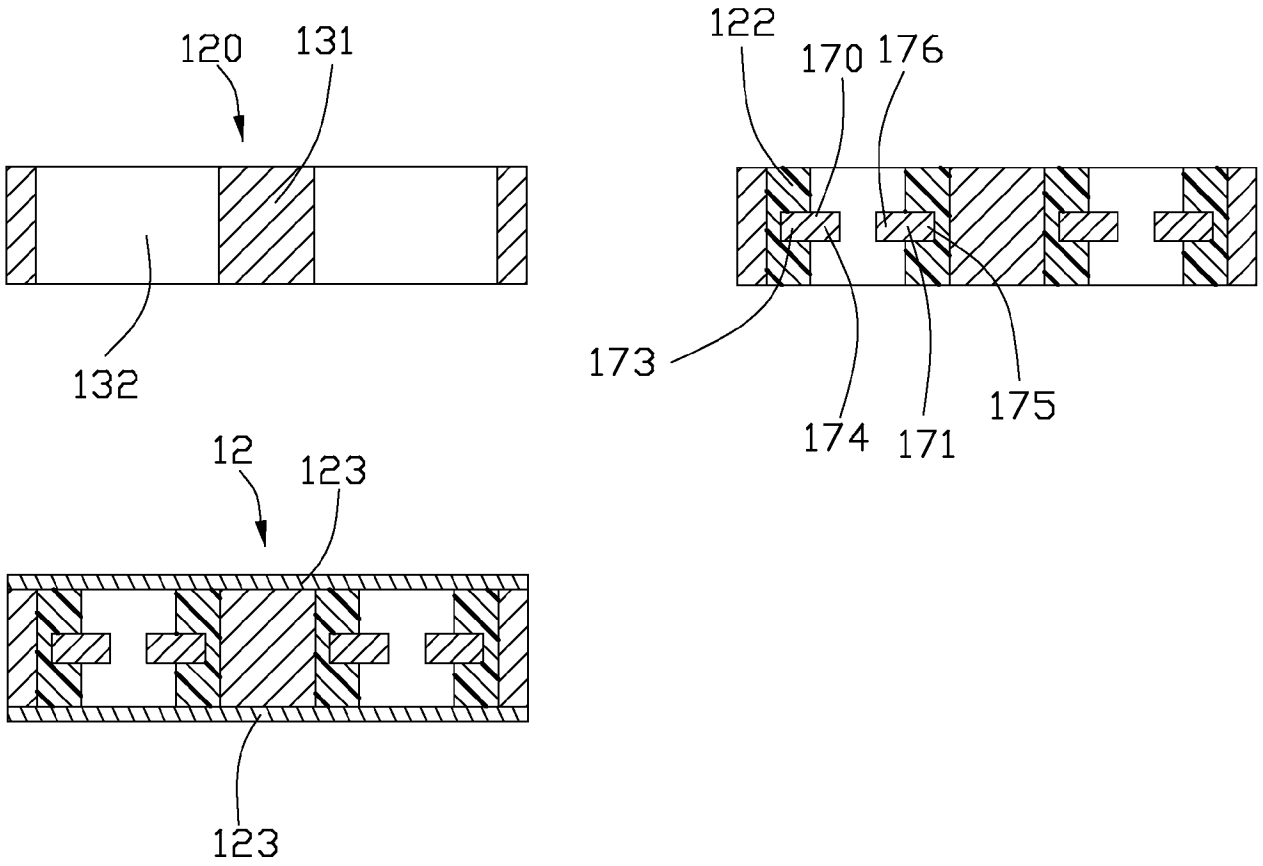
FIG. 18 showing a third method of making the contact wafer shown in FIG. 1.

Referring to FIG. 18, a third method for making an alternative contact wafer 12 is shown. The method includes the following steps: (1) providing a conductive board 130 having through holes 132 therein; (2) insert-molding a contact pair 170, 171 and an insulating holder 122 into the through holes 132 with near edges 174, 176 exposed to air and far edges 173, 175 embedded in the insulating holder 122; (3) covering two metal plate 123 over opposite sides of the conductive board 120.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector adapted to be mounted onto a printed circuit board (PCB), comprising a plurality of wafers stacked in a transverse direction, each wafer comprising:

a conductive board having a first face and an opposite second face perpendicular to the transverse direction, the first face defining a plurality of slots therein; and a plurality of contact modules each received in one of the slots, each contact module comprising an insulating holder and a pair of contacts extending in a signal path, each of said contacts having a contacting portion, a foot portion, and an intermediate portion connecting the contacting portion and the foot portion, the intermediate portions of the contacts in the pair being parallelly fixed in the insulating holder and kept isolated from each other; wherein each pair of contacts are punched from a metal plate and kept in a planar surface with near edges facing to each other and far edges backing away from each other, the far edges of the intermediate portions embedded in the insulating holder and the near edges of the intermediate portions exposed to air in part length of the signal path.

2. An electrical connector as claimed in claim 1, wherein the insulating holder of each contact module has a window with laterals contoured along the intermediate portions of the contact pair to expose the near edges.

3. An electrical connector as claimed in claim 1, wherein the contact modules are separately formed and inserted into the slots of the conductive boards.

4. An electrical connector as claimed in claim 3, wherein the contact modules are separated from each other and completely received in the slots of the conductive board.

5. An electrical connector as claimed in claim 1, further comprising a conductive housing having a front mating face and a rear inserting face, wherein the conductive housing defines a plurality of rectangular holes arrayed in the rear inserting face, the stacked wafers assembled to the rear inserting face with the contacting portions of each pair of the contacts inserted into the holes respectively.

6. An electrical connector as claimed in claim 5, further comprising a plurality of insulating protector, wherein each insulating protector has a rear end received in one slot of the conductive board and a front end received in one hole of the conductive housing.

7. An electrical connector as claimed in claim 6, wherein each of the contact wafers comprises a shielding plate mounted on the first face of the conductive board, the shielding plate having a plurality of tabs forwardly extending beyond a front edge of the conductive board and the contacting portions extending beyond the front edge of the conductive board also, the insulating holders disposed between the contacting portions of the contacts and the tabs of the shielding plate, the contacting portions being deflectable towards the tabs of shielding plate.

8. An electrical connector as claimed in claim 1, further comprising plural grounding belts extending transversely, each grounding belt being mounted upwardly to the stacked wafers and having ground feet to be mounted to the PCB.

9. A contact wafer adapted for an electrical connector, comprising:

a conductive board defining plural slots in a side face, the plural slots extending along parallel paths from a first board edge to a second board edge in the side face;

plural insulating holders received in the slots; and plural pairs of contacts adapted to transfer differential signal, each pair of the contacts extending along the path of a corresponding slot and kept isolated from the conductive board by a corresponding insulating holder; wherein the conductive board is formed by molded plastic coated with metal plating;

wherein in a first length of the path of the slot, corresponding insulating holder has a supporting portion extending fully across a width of the slot thereby making an interference fit in the slot, and in a second length of the path of the slot, corresponding insulating holder is at least partially void to expose the contacts in the air in the slot.

10. A contact wafer as claimed in claim 9, wherein the insulating holders are separated from each other and received in corresponding slots detachably in a direction perpendicular with the side face.

11. A contact wafer as claimed in claim 10, wherein the insulating holder forms a center void portion with two supporting portions disposed at two ends of the second length and two ribs connecting the two supporting portions.

12. A contact wafer as claimed in claim 11, wherein each pair of contacts are punched from a metal plate and kept in a planar surface with near edges facing to each other and far edges backing away from each other, in the second length of the path of the slot, the far edges of the contacts embedded in the insulating holder and the near edges of the contacts exposed in the center void portion.

13. A contact wafer as claimed in claim 9, wherein each pair of contacts have contacting portions deflectable towards a bottom wall of the slot, an insulating protector disposed between the contacting portions and the bottom wall.

14. A contact wafer as claimed in claim 13, wherein each of the insulating protectors defines a pair of cavities receiving the contacting portions of corresponding pair of contacts, each of the insulating protectors forming a rib sheltering front ends of the contacting portions of the contacts.

15. A contact wafer as claimed in claim 9, wherein when the wafer is stacked with a same wafer, one slot of the conductive board forms a hole receiving the contacting portions of the pair of the contacts and the two wafers jointly form a front face contactable to a conductive shroud of a mating header.

16. A contact wafer assembly for use within an electrical connector, comprising:

a plurality of contact wafers stacked with one another in a longitudinal direction of the connector;

each of said contact wafers including:

a conductive board defining in a side face a plurality of slots transversely spaced from one another in a roughly parallel relationship and extending through first and second edges of the conductive board which are perpendicular to each other and both perpendicular to said lengthwise direction;

a plurality of insulative holders disposed in the corresponding slots, respectively, each of said holders being equipped with a differential pair of contacts in an embedded manner, each of said differential pair of contacts defining a mating portion and a foot portion; and at least a shielding plate covering said side face to shield said insualtive holders and the associated contacts therein; wherein the holder and the associated contacts are snugly and circumferentially fully shielded by the conductive board and the associated shielding plate along said slot;

wherein the holder defines at least one void to expose corresponding inner edges of the differential pairs of contacts to air while maintaining corresponding outer edges of the differential pairs of contacts embedded therein.

17. The contact wafer assembly as claimed in claim 16, wherein said void extends along said holder partially.

18. The contact wafer assembly as claimed in claim 17, wherein each of said shielding plates is equipped with foot portions cooperating with the foot portions of the differential pair of contacts for commonly mounting to a printed circuit board on which the connector is seated.

* * * * *